US005998922A

United States Patent [19]

Ozawa et al.

[11] Patent Number: 5,998,922

[45] Date of Patent: Dec. 7, 1999

[54] MOSAIC FIELD EMISSION DISPLAY WITH INTERNAL AUXILIARY PADS

[75] Inventors: Lyuji Ozawa, Hopewelll Junction, N.Y.; Chao-Chi Peng, Hsinchu, Taiwan; Wen-Chun Wang, Hsinchu, Taiwan; Chun-hui Tsai, Hsinchu, Taiwan; Jyh-Haur Tyan, Hsinchu, Taiwan

[73] Assignee: Industrial Technology Research Institute, Hsin-Chu, Taiwan

[21] Appl. No.: 08/938,799

[22] Filed: Sep. 26, 1997

[51] Int. Cl.[6] ..... H01J 1/30; H01J 19/24

[52] U.S. Cl. ..... 313/495; 313/422; 445/24

[58] Field of Search ..... 313/495, 496, 313/497, 422; 345/74, 75; 445/24, 25, 44

[56] References Cited

U.S. PATENT DOCUMENTS

| | | | |
|---|---|---|---|
| 5,063,327 | 11/1991 | Brodie et al. | 313/395 |
| 5,170,100 | 12/1992 | Shi | 313/422 |
| 5,234,541 | 8/1993 | Shannon et al. | 156/651 |
| 5,238,435 | 8/1993 | Te Velde | 445/24 |
| 5,361,079 | 11/1994 | Yamamoto | 313/496 |
| 5,375,005 | 12/1994 | Komano | 359/48 |
| 5,563,470 | 10/1996 | Li | 313/496 |
| 5,603,649 | 2/1997 | Zimmerman | 445/24 |

OTHER PUBLICATIONS

T. Giorgi; Getters & Gettering; Japan J. Appl. Physics Suppl. 2, P&L pp. 53–60, 1994 (No Month.

*Primary Examiner*—Michael Day
*Attorney, Agent, or Firm*—George O. Saile; Stephen B. Ackerman

[57] ABSTRACT

The design of a large area display made up of a plurality of field emission display modules is described. The modules have been modified in several ways relative to prior art designs. The cathode and gate lines near the module's edge have been substantially shortened. This feature, in combination with the use of a rabbet joint for attaching thinner than usual edge plates, allows the modules to be butted up against each other such that pixels in adjoining modules are no further apart than pixels in the same module. Because of the thinner edge plates and the general compatibilty of the process, the use of internal supports between the front and rear plates becomes mandatory. Vacuum piping for the modules is located near an edge in dark space or under a green pixel, with the gettering layer being formed inside the piping. The modules all plug into a printed circuit board which includes a custom chip for driving the display.

13 Claims, 4 Drawing Sheets

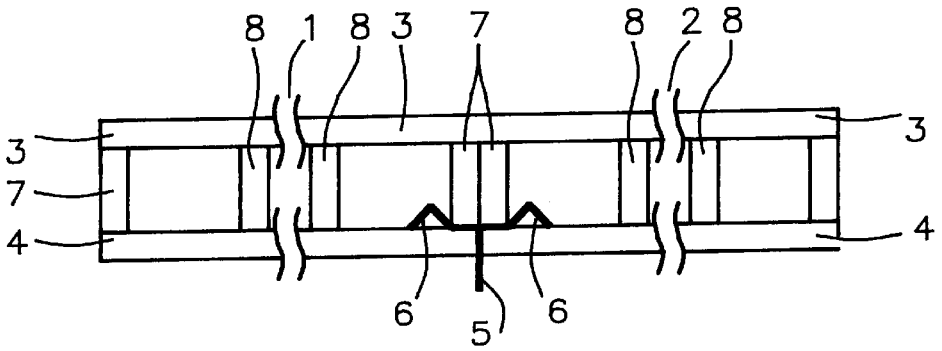
FIG. 1 – Prior Art
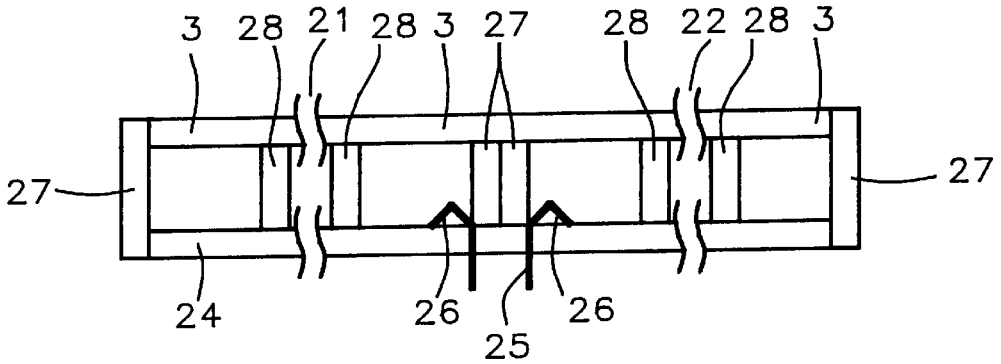
FIG. 2
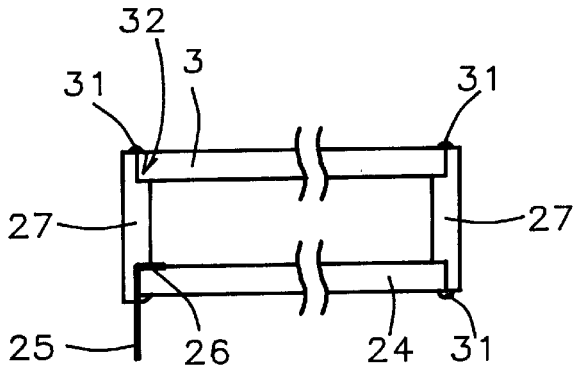
FIG. 3A
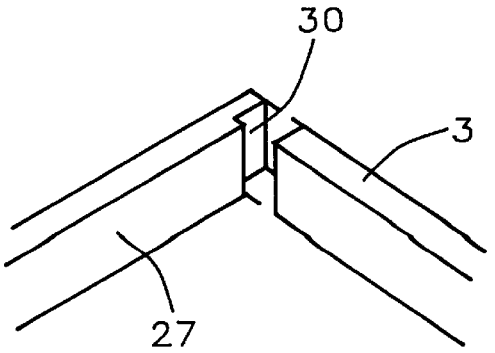
FIG. 3B

MOSAIC FIELD EMISSION DISPLAY WITH INTERNAL AUXILIARY PADS

BACKGROUND OF THE INVENTION (1) Field of the Invention

The invention relates to the general field of emission devices and arrays, more particularly to the design of large displays.

(2) Description of the Prior Art

Cold cathode, or field emission, devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line. Another set of conductive lines (called gate lines) is located a short distance above the cathode lines at an angle (usually 90°) to them, intersecting with them at the locations of the conical emitters or microtips, and connected to a source of positive voltage. Both the cathode and the gate line that relate to a particular microtip must be activated before there will be sufficient voltage to cause cold cathode emission.

The electrons that are emitted by the cold cathodes accelerate past openings in the gate lines and strike a cathodo-luminescent panel that is located a short distance from the gate lines. In general, a significant number of microtips serve together as a single pixel in a monochrome display or as sub-pixels in a color display. Note that, even though the local electric field in the immediate vicinity of a microtip is in excess of 10 million volts/cm., the externally applied voltage is only of the order of 100 volts.

The above described components are normally housed in a flat, vacuum tight, structure consisting of a front anode plate, a rear plate that bears the microtips as well as the power (cathode and gate) lines, separated from one another by side supports, located at their edges. Spacers, located between pixels, are also often provided for added strength, but may be omitted in small units.

The structure is evacuated to a high degreee of vacuum, including post seal gettering, through vacuum piping. The latter are attached, either at the side supports or to a front or rear plate, additional space on the surface being made available to accommodate them. It is then operated by means of external leads that are connected, through glass-metal seals, to the power lines. In general, a standard power supply, located near the array, is used for driving the power lines through the same leads that were used for operating.

In practice, it is not cost effective to manufacture field emission displays that exceed a certain size. In general, field emission displays do not measure more than about 30 inches by 30 inches because of the difficulty of manufacturing and handling glass sheets of uniform thickness that are larger than this. Unlike integrated circuits where many perfect chips may be obtained from a single wafer even if yield is relatively low, each field emission display must be perfect.

Thus, to date, field emission displays have tended to be limited to small area applications (usually having a diagonal measurement of less than 40 inches). This is unfortunate because they represent a highly energy-efficient technology and are able to provide the high level of brightness required by outdoor displays such as score boards or timetables. Additionally, field emission displays are well suited to video applications, should these be needed. The energy efficiency of field emission devices compares with that of the currently used large area technologies as follows:

| TECHNOLOGY | WATTS/LUMEN |
|---|---|
| HV-VFD* | 15 |
| LED** | 25 |
| FED | 30 |

*high voltage vacuum fluorescent displays
**light emitting diodes

Note that for very large displays (large in size but having fewer pixels) the cost per pixel of the initial hardware favors LED devices, but in the size range around 300K pixels (corresponding to a 200 inch diagonal) FED displays, constructed according to the teachings of the present invention, are more cost effective aside from their improved energy efficiency.

In principle, it should be possible to combine many small field emission units into a large display by mounting them side by side. In practice, this is not done because, except for pixel pitches greater than about 5 mm., the separation between modules is found to substantially exceed the separation between pixels. As a result, the assemblage is not seamless and can be seen to be a composite. In practice, the pixel pitch of a display must be designed to be more than twice the separation distance between modules so if, for example, the separation is 2 mm., then the pixel pitch will need to be over 4 mm. Thus, the separation between modules represents the final limitation to the resolution of this type of display.

Additionally, multiple power supplies are needed to drive the multiple modules. Their associated wiring requires leaving room for wiring channels, further limiting the degree of compactness that can be achieved.

In FIG. 1, we illustrate how two individual modules, 1 and 2, are combined into a single unit using currently available methods. Each unit consists of a front plate 3, a rear plate 4, and edge plates 7. Optional spacers 8 are also seen. A set of edge plates, lying in a plane parallel to that of the figure, is not shown. A set of power lines (also not shown) is located on the inside surface of rear plates 4 and contact is made to them through electrode 6 which passes underneath an edge plate 7 and emerges as lead 5. This allows two contacts 6 to be combined into a single lead 5.

The present invention is directed towards improved module designs that can be seamlessly linked together to form a large area display. In the course of searching for prior art, the following references were found to be of interest. Te Velde (U.S. Pat. No. 5,238,435 August 1993) shows a liquid crystal display having very small cell thickness. Komano (U.S. Pat. No. 5,375,005 December 1994) discloses a liquid crystal display device for effectively supporting liquid crystal plate and illuminating device. Shannon et al. (U.S. Pat. No. 5,234,541 August 1993) shows a method of fabricating a MIM type device that is carried on a support together with an array of electrodes and address conductors for an active matrix display. Zimmerman (U.S. Pat. No. 5,603,649 February 1997) describes a self-aligned structure that allows FED devices to be fabricated in any desired size.

SUMMARY OF THE INVENTION

It has been an object of the present invention to provide a design for a large area display comprised of many field emission display modules.

A further object of the present invention has been that the boundaries between the individual modules not be visible to viewers of the large display.

A still further object of the present invention has been that the driving supply and associated wiring of the invention not be visible to viewers of the display.

Another object of the invention has been that the minimum distance between pixels in adjoining modules be substantially the same as the minimum distance between pixels on the same module.

These objects have been achieved by designing field emission display modules in which the cathode and gate lines near a module's edge are substantially shortened. This feature, in combination with the use of a rabbet joint for attaching thinner than usual edge plates, allows the modules to be butted up against each other such that pixels in adjoining modules are no further apart than pixels in the same module. Because of the thinner edge plates, and for reasons of process compatibility, the use of internal supports between the top and bottom plates becomes mandatory. Vacuum piping for the modules is located near an edge in dark space or under a green pixel, with the gettering layer being formed inside the piping. The modules all plug into a printed circuit board which includes a custom chip for driving the display.

BRIEF DESCRIPTION OF THE DRAWINGS

FIG. 1 shows how two field emission display modules would be combined in the prior art.

FIG. 2 shows how two field emission display modules are combined according to the present invention.

FIG. 3A illustrates how the edge plates are attached to the front and rear plates of a module, including bringing out leads.

FIG. 3B is closeup of the rabbet joint featured in FIG. 3A.

DESCRIPTION OF THE PREFERRED EMBODIMENTS

Figure 4:
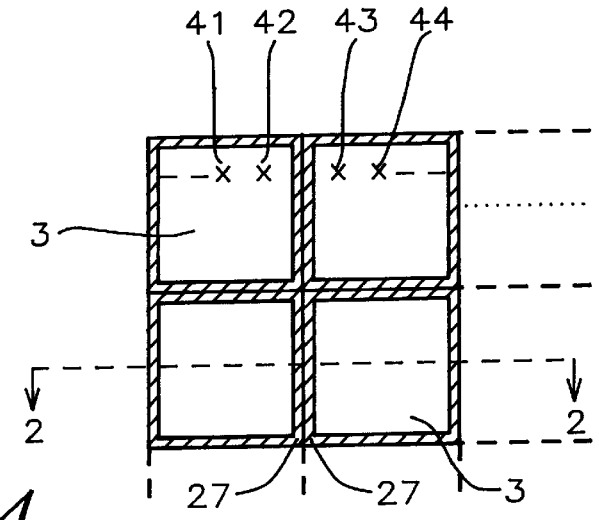
FIG. 4 is a plan view of four modules combined into a single larger array.

Referring now to FIG. 2, we illustrate how two individual modules, 21 and 22, are combined into a single unit using designs based on the present invention. The most important feature shown here is that the separation distance between 21 and 22 has now been reduced to a value that is substantially the same as the separation distance between the pixels within a module (typically between about 1 and 2 mm. for displays having a pixel pitch of about 5 mm.). This has been accomplished by making the effective thickness of edge plates 27 significantly less than that of edge plates 7 in FIG. 1. A typical value for the thickness of 7 would be between about 3 and 4 mm. while the full thickness of 27 is between about 0.5 and 1 mm.

FIG. 3A shows how the thickness of 27 has been reduced insofar as affecting the separation distance from an adjoining module, over and above the reduction in its overall thickness. This is important since 27 will need to be able to stand up to atmospheric pressure. Instead of a simple butt joint (as between 7 and 3 in FIG. 1) a rabbet joint 32 can be used. As seen in closeup detail FIG. 3B, the rabbet joint is formed by inserting one end of front plate 3 (or rear plate 24) into previously formed half-lap 30.

Sealing of the joint is effected by first lining both halves of the joint with glass frit (shown as 31 in FIG. 3A) and then firing, typically at between about 400 and 600° C. Far between about 30 and 180 minutes. The use of this type of joint has the added advantage that it requires little or no extra jigging to first join electrode 25 to the end of a power line (at 26 for example) before 24 and 27 are brought together and the seal formed. Note that electrode 25 emerges from the module in a downward direction in the form of a stiff pin suitable for insertion into a printed circuit (pc) board (not shown).

FIG. 4 is a plan view showing (schematically) how four field emission array modules may be butted together to form (part of) a larger array. Pixels are schematically shown as Xs 41 to 44. As already indicated above, the distance between 41 and 42 or between 43 and 44 is substantially the same as the distance between 42 and 43. FIG. 2 is a cross-section, taken at 2—2, of FIG. 4. Not shown in FIG. 4, are the spacers 28. Because of its reduced thickness, 27 will not have the strength to support the top and bottom plates so the spacers, optional in prior art designs, become mandatory in designs based on the present invention.

Figure 5:
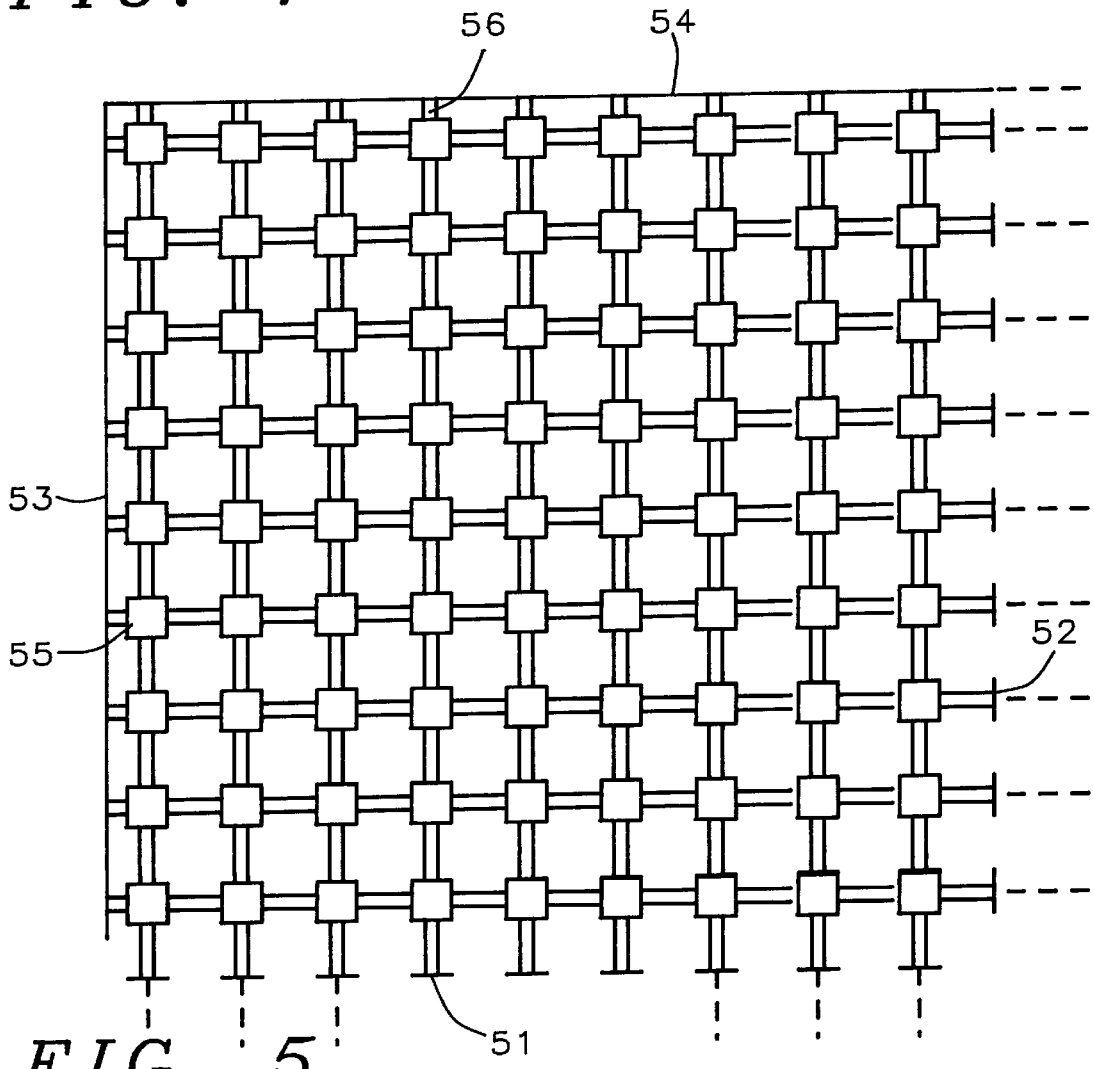
FIG. 5 is a view of part of an array module showing how the cathode and gate lines are abbreviated when they reach an edge.

In order for the distance between pixels 42 and 43 (FIG. 4) to be sufficiently small it is necessary that the length of the power line that lies between them and the edge of the module be reduced to a minimum. Referring now to FIG. 5, we show part of a field emission module having a left edge 53 and a top edge 54. Cathode lines, such as 51, run in a vertical direction while gate lines, such as 52, run in a horizontal direction. At the intersection of each cathode line with each gate line a pixel is seen.

FIG. 5 shows how cathode line 51 has been cut short at 56 where it meets upper edge 54 while gate line 52 has been cut short at 55 where it meets left edge 53. The length of end segments such as 55 and 56 is between about 1 and 2 mm. which is needed for the attachment of leads 26 to the power lines. Introducing a no light region between modules makes the separation distance between 42 and 43 larger. The present invention solves this problem by providing auxiliary pads, one for each power line, located in the dark areas between pixels.

Figure 6:
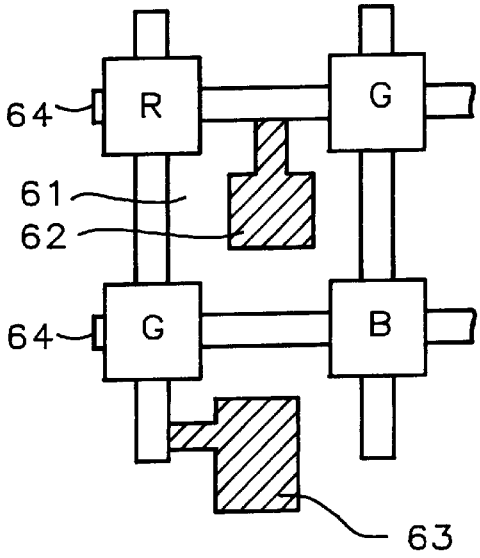
FIG. 6 is a closeup of a single color pixel at the edge of an array module showing how auxiliary pads have been located in the dark space between pixels.

FIG. 6 is an enlarged view of a single pixel, showing the four color subpixels, one red (R), one blue (B), and two green (G). The reason there are two green for each blue and red is to increase the brightness for viewers. As can be seen, there is empty (or dark) space such as 61 between the subpixels which the present invention makes use of for the location of auxiliary pads such as 62 for a gate line and 63 for a cathode line. We can thus remove most of shadow area 64, allowing 42 and 43 to be brought closer together.

As mentioned earlier, it has been preferred in designs of the prior art to locate the vacuum piping (which includes a hole drilled in the top or bottom plate as well as the associated exterior tubing), used to evacuate the modules, in a peripheral (non screen) area. However, in a mosaic type of design we cannot have any peripheral region as this would increase the 'no light' area between pixels located in different modules. This forces us to attach the vacuum piping in a screen area, but in dark space between pixels.

Figure 7A:
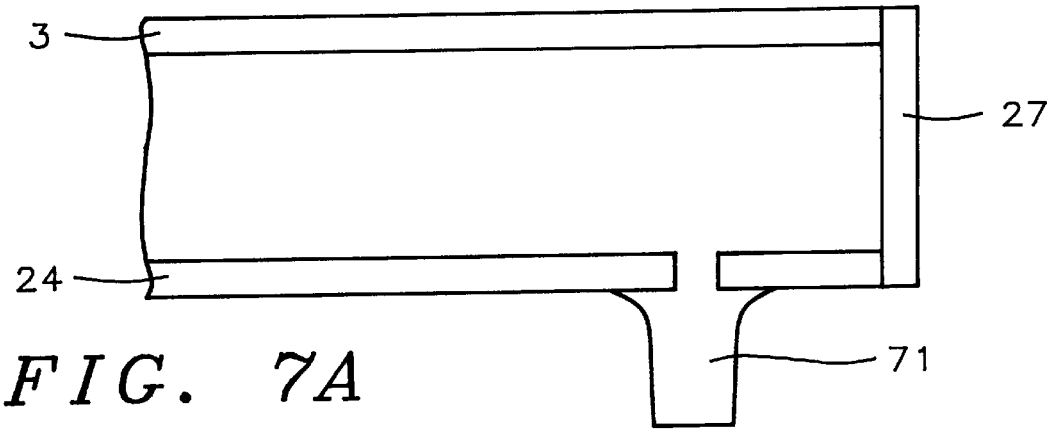
FIG. 7A is a cross-section through part of FIG. 7B.
Figure 7B:
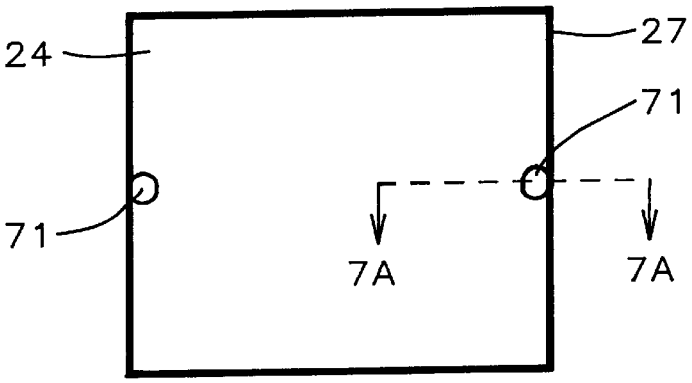
FIG. 7B is a plan view showing the location of the vacuum piping used for the evacuation of modules.

The present invention's solution to the problem of where to locate the vacuum piping is illustrated in FIG. 7A. Vacuum piping 71 is located in rear plate 24 close to edge plate 27. The exact position of 71 (whose inside diameter is between about 0.5 and 3 mm.) is either underneath a dark area such as 61 in FIG. 6 or underneath one of the green subpixels whose loss would be perceptible in view of the presence of a second green sub-pixel. FIG. 7B is a plan view of a single module showing the positions of two vacuum pipes 71. FIG. 7A is the cross-section marked as 7A—7A.

Because of outgassing after vacuum sealing, etc. it is common practice to evaporate a layer of a gettering material onto an inside surface of the module after the vacuum has been sealed in. Because surface space is at a premium inside a module of the present invention's design, we have found an effective surface for placing the getter to be the inside walls of the vacuum piping. This avoids the problem of inadvertently coating a pixel or a power line with getter.

Figure 8:
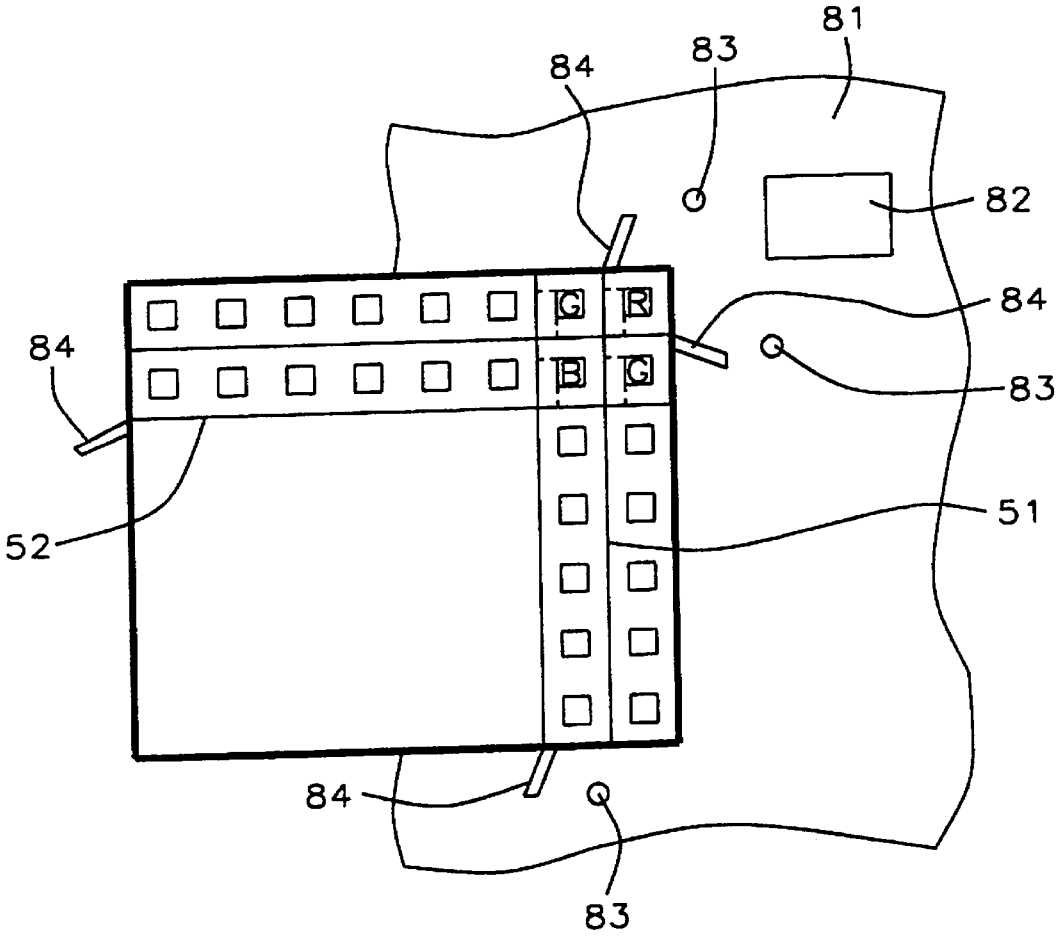
FIG. 8 shows how an array module plugs into a pc board.

As mentioned earlier, conventional power supplies for driving field emission arrays are bulky and require wiring channels near the modules. To avoid this problem we have developed a custom integrated circuit chip that is dedicated to the single function of driving the array, whether statically or dynamically. The custom chip is located outside of the mosaic and is commonly incorporated as part of the printed circuit board into which the modules are plugged. This can be seen schematically in FIG. 8 as chip 82 which has been mounted on printed circuit board 81. Also shown are connector pins 84 which plug into plated through-holes 83 on the PC board 81. Typically, a custom driver chip is capable of driving between about 1 and 100 gate lines and between about 1 and 100 cathode lines, corresponding to about 1–9 modules, depending on module size and pixel pitch.

While the invention has been particularly shown and described with reference to the preferred embodiments thereof, it will be understood by those skilled in the art that various changes in form and details may be made without departing from the spirit and scope of the invention.

What is claimed is:

1. A mosaic field emission array comprising:

a plurality of field emission array modules, each module having between about 1 and 10,000 color pixels with separation distances between them, a front plate, a rear plate, with edges, on which the pixels form an array, edge plates, spacers to separate the front and rear plates, and power lines for activating the pixels;

internal auxiliary pads, one per power line, located between pixels, for the purpose of connecting said power lines to circuits on a pc board; and means for holding the modules in a mosaic pattern, whereby the modules abut one another at their edge plates so that pixels in adjoining modules are separated by an amount equal to said separation distance.

2. The array described in claim 1 wherein said power lines are on the rear plate and further comprise orthogonally disposed cathode lines and gate lines.

3. The array described in claim 2 wherein a custom integrated circuit chip is provided for the purpose of driving between about 1 and 100 gate lines, the chip being located outside the mosaic.

4. The array described in claim 2 wherein a custom integrated circuit chip is provided for the purpose of driving between about 1 and 100 cathode lines, the chip being located outside the mosaic.

5. The array described in claim 1 wherein the edge plates further comprise four plates, each edge plate being joined to an upper plate at a first rabbet joint and to a lower plate at a second rabbet joint through which passes a connecting electrode, said connecting electrode contacting a power line at a first edge and emerging, at a second edge, as a pin that extends downwards from said lower plate.

6. The array described in claim 5 wherein the pin plugs into a printed circuit board.

7. The array described in claim 1 wherein the minimum distance between pixels, within modules and between modules, is between about 1 and 2 mm.

8. The array described in claim 1 further comprising vacuum piping, said vacuum piping being limited to the rear plates and emerging therefrom in a downward direction.

9. The array described in claim 8 wherein gettering material is located inside the vacuum piping.

10. The array described in claim 8 wherein there are multiple vacuum pipes per module and the inside diameter of the vacuum piping is between about 0.5 and 3 mm.

11. The array described in claim 1 wherein the front plate serves as an anode for the module.

12. A process for manufacturing a mosaic field emission array comprising:

manufacturing a plurality of field emission array modules, each module having between about 1 and 10,000 color pixels, a front plate, a rear plate, on which the pixels form an array, edge plates, spacers to separate the front and rear plates, and power lines for activating the pixels;

using leads which connect the power lines by means of internal auxiliary pads; and butting the modules up against each other at opposing edge plates to form a permanent mosaic pattern having the appearance of a single large field emission array.

13. The process described in claim 12 further comprising evacuating said modules through vacuum piping attached to the rear plates and depositing gettering material inside the vacuum piping.

* * * * *